US010828891B2

(12) United States Patent
Hiyoshi

(10) Patent No.: US 10,828,891 B2
(45) Date of Patent: Nov. 10, 2020

(54) INK JET HEAD AND INK JET PRINTER

(71) Applicant: TOSHIBA TEC KABUSHIKI KAISHA, Tokyo (JP)

(72) Inventor: Teruyuki Hiyoshi, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/570,321

(22) Filed: Sep. 13, 2019

(65) Prior Publication Data

US 2020/0198326 A1 Jun. 25, 2020

(30) Foreign Application Priority Data

Dec. 20, 2018 (JP) ..... 2018-238572

(51) Int. Cl.
*B41J 2/045* (2006.01)

(52) U.S. Cl.
CPC ..... *B41J 2/0457* (2013.01); *B41J 2/0451* (2013.01); *B41J 2/04541* (2013.01); *B41J 2/04548* (2013.01); *B41J 2/04581* (2013.01)

(58) Field of Classification Search
CPC ..... B41J 2/0457
See application file for complete search history.

(56) References Cited

U.S. PATENT DOCUMENTS 4,930,918 A * 6/1990 Steppe ..... B41J 29/00 337/11
2003/0142155 A1 7/2003 Umeda
2007/0008382 A1 1/2007 Hatsui et al.
2012/0212980 A1* 8/2012 Kato ..... B41J 29/38 363/21.12
2012/0306948 A1 12/2012 Fujisawa

FOREIGN PATENT DOCUMENTS

CN 204119022 U 1/2015
JP S57113724 A 7/1982
JP H06-86597 A 3/1994
JP 2010-000776 A 1/2010
JP 2010279229 A * 12/2010 ..... H01H 85/0241
JP 2017221008 A * 12/2017

OTHER PUBLICATIONS

Extended European Search Report dated Apr. 23, 2020, mailed in counterpart European Patent Application No. 19198692.6, 13 pages.

* cited by examiner

*Primary Examiner* — Shelby L Fidler
(74) *Attorney, Agent, or Firm* — Kim & Stewart LLP

(57) ABSTRACT

An ink jet head includes an actuator, a driver IC, a first capacitor, a second capacitor, and a fuse. The actuator is configured to cause ink to be discharged from nozzles. The driver IC is configured to drive the actuator. The first capacitor is connected between a ground line and a first node of a power supply line connected to the driver IC. The second capacitor is connected between a ground line and a second node of the power supply line. A capacitance of the second capacitor is less than a capacitance of the first capacitor. The fuse is on the power supply line between the first node and the second node.

20 Claims, 9 Drawing Sheets

INK JET HEAD AND INK JET PRINTER

CROSS-REFERENCE TO RELATED APPLICATION

This application is based upon and claims the benefit of priority from Japanese Patent Application No. 2018-238572, filed on Dec. 20, 2018 the entire contents of which are incorporated herein by reference.

FIELD

Embodiments described herein relate generally to an ink jet head and an ink jet printer.

BACKGROUND

An ink jet printer that forms an image on a printing medium according to printing data is in practical use. The ink jet printer includes an ink jet head and a head controller that controls the ink jet head. The ink jet head includes an actuator for discharging ink and a driver IC for driving the actuator based upon the control of the head controller. The driver IC supplies a current from a power supply line having high potential to the actuator by switching a semiconductor switch using a logic circuit. The switching is based upon control from the head controller.

When high voltage power is supplied directly to the driver IC without supplying power to the logic circuit, that is, when the high voltage power is supplied when the power supply of the logic circuit has a problem, such as a short circuit to GND or the like, a through-current may flow from a high voltage power supply line to the GND via the driver IC. When such a through-current flows, there is a possibility that a temperature of the driver IC abruptly rises, a package of the driver IC is broken, and a resin-based packaging is gasified, and smoke or flame ignition occurs. It is possible to prevent the through-current from continuing to flow by providing a fuse in the power supply line. However, in order to prevent the fuse from being melted by the current flowing through the power supply line during the normal operation of the driver IC, it is required to use a fuse having a large amperage rating. Since the size of the fuse is proportional to the amperage rating, there is a problem that the ink jet head may be enlarged by the need to accommodate the large fuse.

DETAILED DESCRIPTION

Embodiments provide an ink jet head and an ink jet printer capable of achieving not only safety but also miniaturization.

In general, according to an embodiment, an ink jet head includes an actuator, a driver IC, a first capacitor, a second capacitor, and a fuse. The actuator is configured to cause ink to be discharged from nozzles. The driver IC is configured to drive the actuator. The first capacitor is connected between a ground line and a first node of a power supply line connected to the driver IC. The second capacitor is connected between a ground line and a second node of the power supply line. The second node is between the first node and the driver IC. A capacitance of the second capacitor is less than a capacitance of the first capacitor. The fuse is on the power supply line between the first node and the second node.

Hereinafter, an ink jet printer and an ink jet head according to an embodiment will be described with reference to the accompanying drawings.

Figure 1:
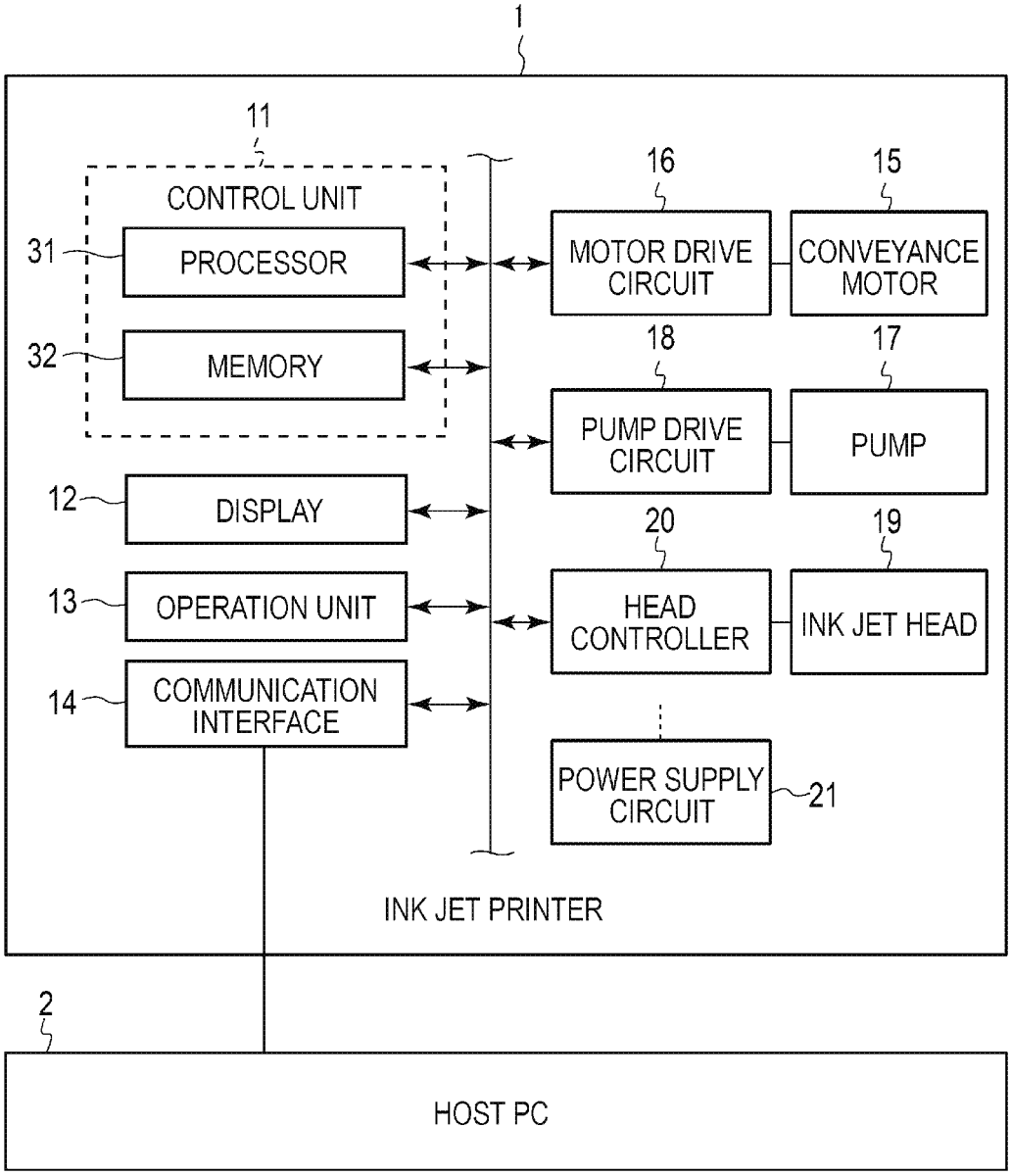
FIG. 1 is a block diagram illustrating an example of a configuration of an ink jet printer according to an embodiment.

First, an ink jet printer 1 according to the embodiment will be described. FIG. 1 is a block diagram illustrating a configuration example of the ink jet printer 1 according to the embodiment.

The ink jet printer 1 is an example of an ink jet recording apparatus. Further, the ink jet recording apparatus is not limited thereto, and may be another apparatus such as a copying machine.

The ink jet printer 1 performs various kinds of processing such as image formation while conveying a printing medium which is a recording medium. The ink jet printer 1 includes a control unit 11, a display 12, an operation unit 13, a communication interface 14, a conveyance motor 15, a motor drive circuit 16, a pump 17, a pump drive circuit 18, an ink jet head 19, a head controller 20, and a power supply circuit 21. The ink jet printer 1 also includes a paper feed cassette and a paper discharge tray.

The control unit 11 controls the ink jet printer 1. The control unit 11 includes a processor 31 and a memory 32. The processor 31 is an arithmetic element for executing arithmetic processing. The processor 31 performs various processing based upon, for example, a program stored in the memory 32 and data used by the program. The memory 32 stores the program and the data used by the program.

The display 12 is a display apparatus that displays a screen according to a video signal sent by the processor 31 or a display control unit such as a graphic controller.

The operation unit 13 generates an operation signal based upon a user input operation or the like. The operation unit 13 is, for example, a touch sensor, a ten-key numeric keypad, a power key/button, a paper feed key/button, various device function keys, a keyboard, or the like. The touch sensor is, for example, a resistance film type touch sensor or a capacitance type touch sensor, and the like. The touch sensor acquires information indicating a position selected within a certain region. The touch sensor is configured as a touch panel integrally with a display 12, and generates a signal indicating a touched position of the screen displayed on the display 12.

The communication interface 14 is an interface that communicates with other devices. The communication interface 14 is used, for example, for communication with a host PC 2 that transmits printing data to the ink jet printer 1. The communication interface 14 communicates with the host PC 2 through a wired network. Further, the communication interface 14 may be configured to communicate with the host PC 2 via a wireless network.

The conveyance motor 15 operates one or more conveyance members for conveying a printing medium (e.g., a sheet of paper) along a conveyance path by motor rotation. A conveyance member in this context is, for example, a belt, a roller, a guide, or the like used to convey the printing medium along the conveyance path. The conveyance motor 15 conveys the printing medium along a positioning guide by driving a roller that operates in conjunction with a belt.

The motor drive circuit 16 drives the conveyance motor 15. The motor drive circuit 16 drives the conveyance motor 15 according to a conveyance control signal from the control unit 11. Accordingly, the printing medium from a paper feed cassette can be conveyed to a paper discharge tray after passing the ink jet head 19. The paper feed cassette is a cassette that stores printing media. The paper discharge tray is a tray that stores a printing medium discharged from the ink jet printer 1.

The pump 17 includes a tube that connects the ink jet head 19 and an ink tank holding ink and. Specifically, the tube connects to a common ink chamber of the ink jet head 19.

The pump drive circuit 18 supplies the ink from the ink tank to the common ink chamber of the ink jet head 19 by driving the pump 17 according to an ink supply control signal from the processor 31.

The ink jet head 19 is an image forming unit that forms an image on the printing medium. Based on a power supply voltage and a control signal supplied from the head controller 20, the ink jet head 19 forms an image by discharging ink onto the printing medium conveyed by the conveyance motor 15 and a holding roller. The ink jet printer 1 may include, for example, a plurality of ink jet heads 19 respectively corresponding to colors such as cyan, magenta, yellow, black, and the like.

The head controller 20 is a circuit that controls the ink jet head 19. The head controller 20 discharges ink from the ink jet head 19 by operating the ink jet head 19. The head controller 20 supplies a plurality of power supply voltages to the ink jet head 19. Further, the head controller 20 generates the control signal based upon the printing data input via the communication interface 14. The head controller 20 supplies the power supply voltage and the control signal, thereby causing the ink jet head 19 to form an image on the printing medium.

The power supply circuit 21 converts AC power supplied from a commercial power supply into DC power. The power supply circuit 21 supplies the DC power to each configuration in the ink jet printer 1.

Figure 2:
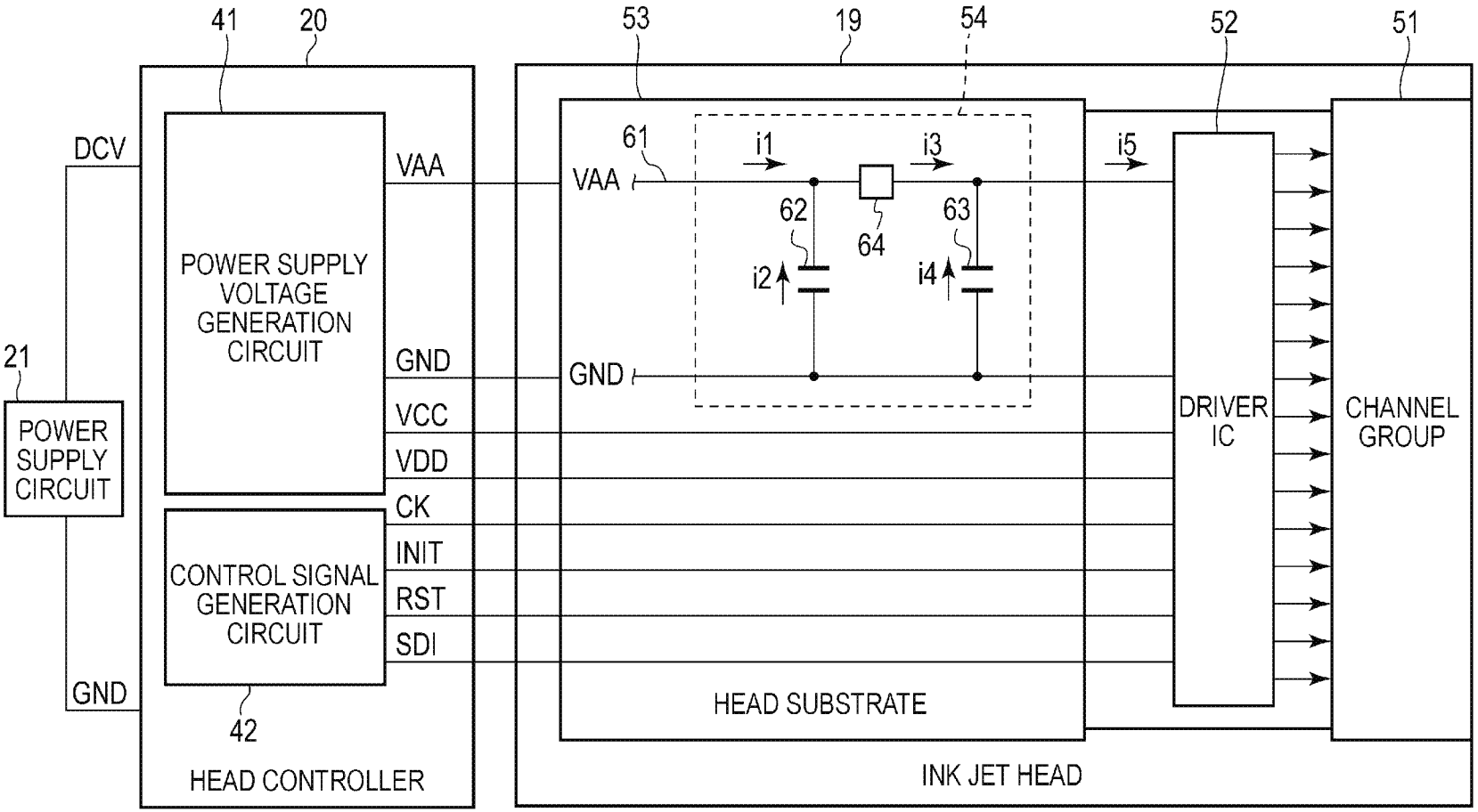
FIG. 2 is a circuit diagram illustrating an example of a configuration of an ink jet head and a head controller.

FIG. 2 is a circuit diagram illustrating the ink jet head 19 and the head controller 20. The ink jet head 19 and the head controller 20 are connected to each other via a flexible printed circuit (FPC) substrate for transmissions. Accordingly, the head controller 20 can supply the power supply voltage and the control signal to the ink jet head 19.

First, the head controller 20 will be described.

The head controller 20 includes a power supply voltage generation circuit 41 and a control signal generation circuit 42.

The power supply voltage generation circuit 41 generates a plurality of power supply voltages required for the operation of the ink jet head 19 and a power supply voltage required for the operation of the control signal generation circuit 42 by using a DC voltage DCV supplied from the power supply circuit 21.

For example, the power supply voltage generation circuit 41 generates a power supply voltage VAA, a power supply voltage VCC, and a power supply voltage VDD by using the DC voltage DCV. The power supply voltage VAA, the power supply voltage VCC, and the power supply voltage VDD are the power supply voltages used in the ink jet head 19. The power supply voltage generation circuit 41 supplies the power supply voltage VAA, the power supply voltage VCC, and the power supply voltage VDD to the ink jet head 19. The power supply voltage generation circuit 41 also generates the power supply voltage for operating the control signal generation circuit 42 by using the DC voltage DCV. The power supply voltage generation circuit 41 supplies the power supply voltage for the control signal generation circuit 42 to the control signal generation circuit 42.

The control signal generation circuit 42 generates a control signal based upon the printing data received via the communication interface 14. The control signal includes a clock signal CK, a reset signal RST, an initialization signal INIT, printing data SDI, and the like. The control signal generation circuit 42 outputs the control signal to the ink jet head 19.

The ink jet head 19 includes a channel group 51, a driver IC 52, and a head substrate 53. The driver IC 52, a wiring connecting the driver IC 52 and the channel group 51, and a wiring connecting the head substrate 53 and the driver IC 52 are configured as a Chip On Film (COF) package. The COF package is configured in such a manner that a wiring is formed on a film-shaped resin material such as a polyimide film and the driver IC 52 is thereon. Further, the ink jet head 19 may include a heat sink (such as a heat radiation fin) for releasing the heat of the driver IC 52.

The channel group 51 is a member that discharges ink. The channel group 51 is configured by arranging a plurality of channels for discharging the ink according to the applied voltage. The channel group 51 includes a first piezoelectric member, a second piezoelectric member joined to the first piezoelectric member, a plurality of electrodes, and a nozzle plate.

The first piezoelectric member and the second piezoelectric member are joined to each other so that polarization directions thereof are opposite to each other. A plurality of parallel grooves from the second piezoelectric member side to the first piezoelectric member side is formed on the first piezoelectric member and the second piezoelectric member. Further, the electrode is formed for each groove. The first piezoelectric member and the second piezoelectric member sandwiched between two electrodes formed in two grooves are configured as an actuator to be deformed by a potential difference between the two electrodes.

The nozzle plate functions to seal the groove. In the nozzle plate, a plurality of discharge nozzles which connect the grooves with the outside of the ink jet head 19 is formed for each groove. Further, the groove when sealed by the nozzle plate functions as a pressure chamber which is filled with ink by the pump 17 and whose wall is formed by a pair of actuators.

When a drive waveform is input from the driver IC 52 to the electrode of an actuator forming the wall of the pressure chamber, the actuator is deformed and thus the volume of the pressure chamber is changed. Accordingly, the pressure of the pressure chamber is changed and thus the ink in the pressure chamber can be discharged from the discharge nozzle by the pressure change. In this example, the combination of a pressure chamber and a discharge nozzle is referred to as a channel. That is, here the channel group 51 includes channels matching the number of grooves.

The driver IC 52 drives the plurality of actuators of the channel group 51 by controlling the potentials of the electrodes of the plurality of actuators of the channel group 51. The driver IC 52 generates the drive waveform based upon the various power supply inputs, such as the power supply voltage VAA, the power supply voltage VCC, the power supply voltage VDD, along with various control signals, such as the clock signal CK, the reset signal RST, the initialization signal INIT, the printing data SDI, and the like. The driver IC 52 deforms the actuator by transmitting the drive waveform to the electrode of the actuator of the channel group 51, thereby changing the volume of the pressure chamber. Accordingly, the driver IC 52 discharges the ink in the pressure chamber through the discharge nozzle.

For example, the driver IC 52 includes a logic circuit, a level shifter, and a driver.

The logic circuit is operated by the power supply voltage VDD. The logic circuit generates a drive signal for controlling a switching element of the driver of the driver IC 52 based upon the clock signal CK, the reset signal RST, the initialization signal INIT, and the printing data SDI input as the control signals. The logic circuit supplies the drive signal to the level shifter.

The level shifter converts a voltage level of the drive signal from the logic circuit by using the power supply voltage VCC. The level shifter inputs the drive signal obtained by converting the voltage level thereof to the driver.

The driver includes, for example, a switching element configured with a p-MOSFET and a switching element configured with an n-MOSFET for each electrode of the channel group 51. Gates of the switching elements are respectively connected to output terminals of the level shifters. A source of the p-MOSFET is connected to the power supply voltage VAA. Further, a source of the n-MOSFET is connected to GND. Further, respective drains which are connection points of the two switching elements are connected to the electrodes of the channel group 51. According to the configuration described above, the driver outputs the power supply voltage VAA or the GND level at a timing corresponding to the drive signal input from the level shifter. Accordingly, the driver inputs the drive waveform to each electrode of the channel group 51. As a result, the driver causes the discharge nozzle of the channel group 51 to discharge the ink.

The head substrate 53 relays the power supply and control signals from the head controller 20 to the driver IC 52. The head substrate 53 includes a protection circuit 54. Further, the head substrate 53 includes a power supply line 61 that supplies the power supply voltage VAA supplied from the head controller 20 to the driver IC 52, and a GND wiring. Further, the head substrate 53 includes a plurality of supply lines that supply the power supply voltage VCC, the power supply voltage VDD, the clock signal CK, the reset signal RST, the initialization signal INIT, and the printing data SDI supplied from the head controller 20 to the driver IC 52.

When the through current flows from the high voltage power supply line 61 to the GND in the driver IC 52 in a state of generating a failure that a high voltage power is supplied without supplying power to the logic circuit of the driver IC 52, the protection circuit 54 serves as a circuit that prevents the through current from continuing to flow in the driver IC 52. The protection circuit 54 includes a first capacitor 62, a second capacitor 63, and a fuse 64.

The first capacitor 62 is a large capacity bypass capacitor for supplying a current to the driver IC 52 at a high speed. The first capacitor 62 is, for example, a ceramic capacitor having a high inductive capacity. In the first capacitor 62, a high-voltage side terminal is connected to the power supply line 61, and a low-voltage side terminal is connected to the GND. The first capacitor 62 is charged by the power supply voltage VAA from the power supply line 61. Further, the first capacitor 62 may be an electric field capacitor.

The second capacitor 63 is a capacitor for supplying a current to the driver IC 52 at a high speed. The second capacitor 63 is a capacitor having a capacitance value lower than that of the first capacitor 62. The second capacitor 63 is, for example, a ceramic capacitor having a high inductive capacity. The second capacitor 63 is connected to the first capacitor 62 in parallel with respect to the driver IC 52. That is, in the second capacitor 63, the high-voltage side terminal is connected to the power supply line 61, and the low-voltage side terminal is connected to the GND. The second capacitor 63 is charged by the power supply voltage VAA and the first capacitor 62 via the power supply line 61. Further, the second capacitor 63 may be an electric field capacitor.

The fuse 64 is an element that melts or the like when a current equal to or greater than 250% of a rated current flows for 5 seconds and thus opens a circuit. The fuse 64 functions as a conductor when current within the rating flows. The fuse 64 is melted by Joule heat generated when the current flows. The fuse 64 is connected between a connection point between the first capacitor 62 and the power supply line 61 and a connection point between the second capacitor 63 and the power supply line 61. That is, the fuse 64 is connected closer to the side of the driver IC 52 than the first capacitor 62, and the second capacitor 63 is connected to a rear stage of the fuse 64. The fuse 64 functions as a part of the power supply line 61 when the current within the rating flows. Further, the fuse 64 is melted when the current equal to or greater than 250% of the rated current flows for 5 seconds and then disconnects the connection between the power supply line 61 and the driver IC 52.

Next, an operation of the ink jet head 19 will be described.

Figure 3:
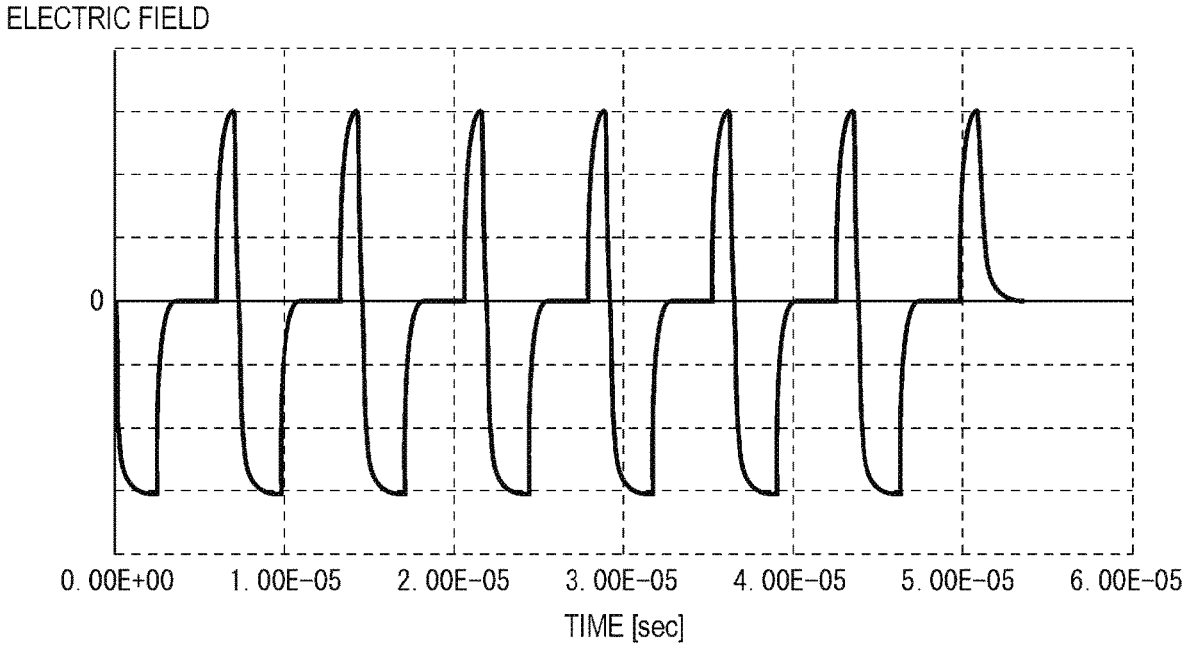
FIG. 3 is a graph illustrating an example of an electric field applied to an actuator of the ink jet head.

FIG. 3 illustrates an example of a drive waveform of an actuator. A horizontal axis of FIG. 3 indicates time, and a vertical axis thereof indicates strength of an electric field applied to the actuator.

The driver IC 52 drives the channel group 51 by inputting the drive waveform shown in FIG. 3 to the electrode of the actuator of the channel group 51. An example of FIG. 3 is a drive waveform when driving is performed at the maximum drive voltage of the product specification of the ink jet head 19. Further, it is assumed that the maximum drive voltage of the product specification of the ink jet head 19 is the power supply voltage VAA of 31 [V]. Further, since the first capacitor 62 and the second capacitor 63 are ceramic capacitors having the high inductive capacity, capacitance values thereof change depending on a bias to be applied. In this example, the description will continue on the assumption that the capacitance value of the first capacitor 62 is 10 [μF] and the capacitance value of the second capacitor 63 is 1 [μF] when the bias is not applied; and the capacitance value of the first capacitor 62 is 4 [μF] and the capacitance value of the second capacitor 63 is 0.44 [μF] when the bias is applied.

Figure 4:
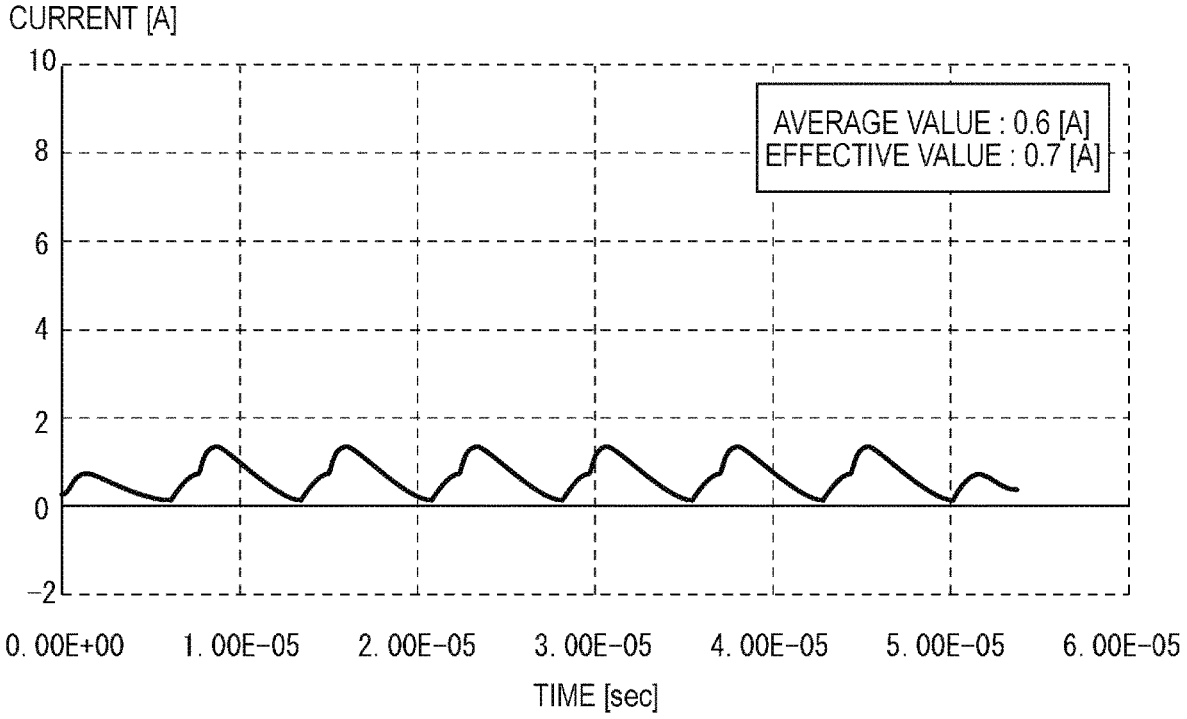
FIG. 4 is a graph illustrating an example of a current during an operation of the ink jet head.
Figure 5:
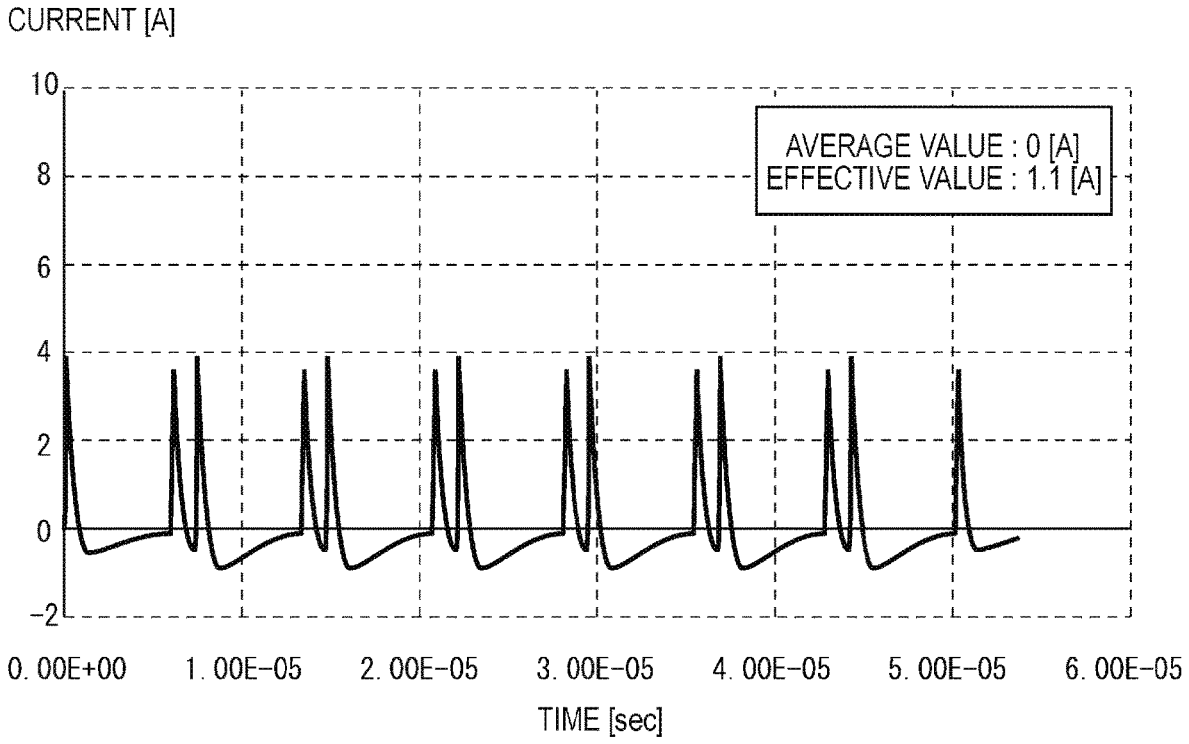
FIG. 5 is graph illustrating an example of a current during an operation of the ink jet head.
Figure 6:
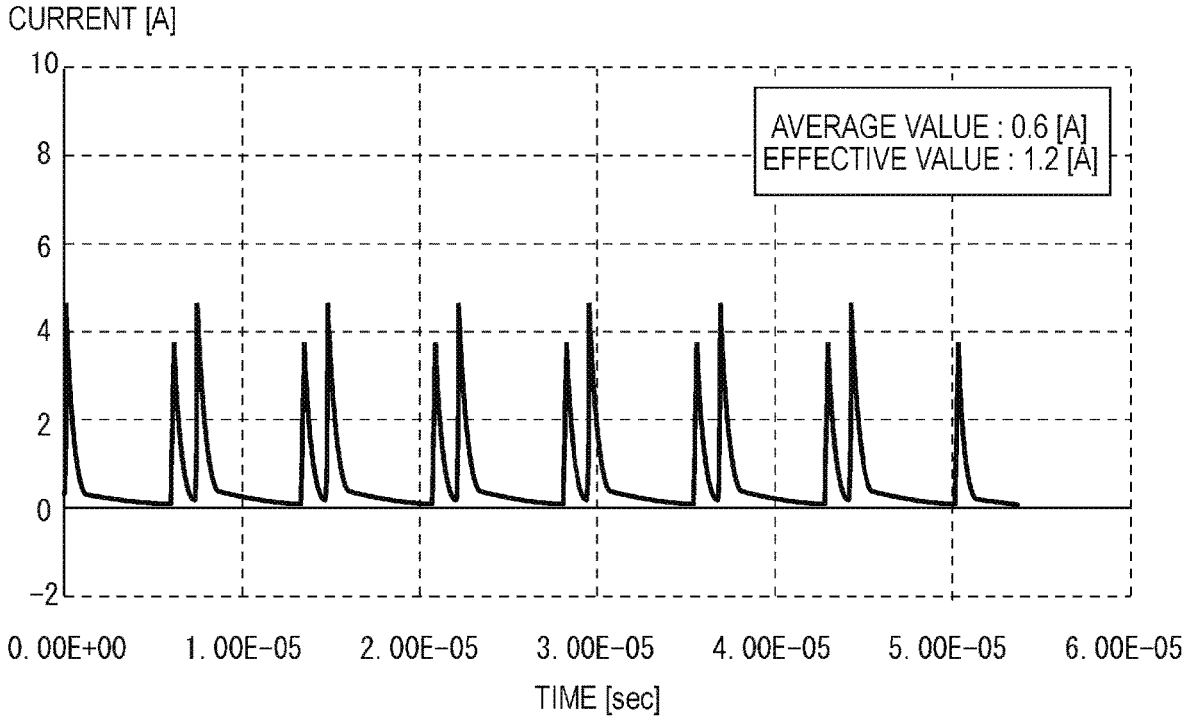
FIG. 6 is graph illustrating an example of a current during an operation of the ink jet head.
Figure 7:
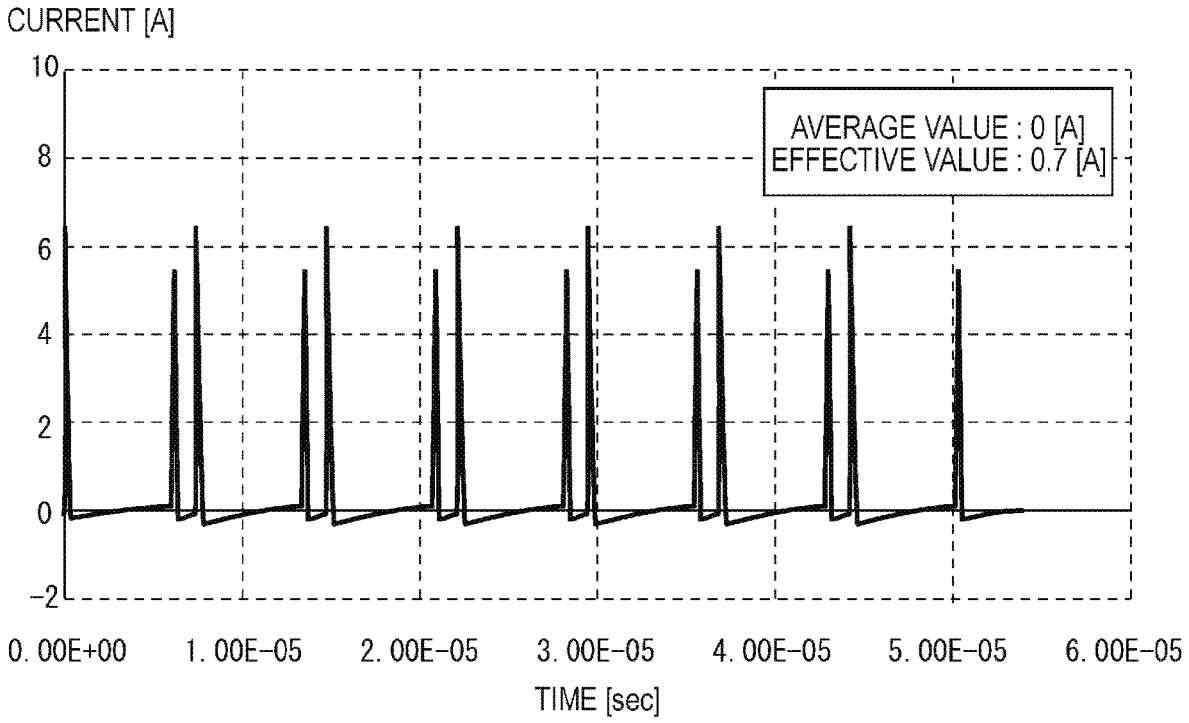
FIG. 7 is graph illustrating an example of a current during an operation of the ink jet head.

FIGS. 4 to 7 are graphs illustrating an example of a current in the protection circuit 54. FIG. 4 illustrates an example of a current i1 according to the power supply voltage VAA supplied from the head controller 20 via the power supply line 61. FIG. 5 illustrates an example of a current i2 generated by the potential of the first capacitor 62. FIG. 6 illustrates an example of a current i3 flowing through the fuse 64. FIG. 7 illustrates an example of a current i4 generated by the potential of the second capacitor 63.

As described above, the first capacitor 62 is charged by the current i1 according to the power supply voltage VAA to be supplied from the head controller 20 via the power supply line 61. The current i1 is a current for replenishing an electric charge discharged by the first capacitor 62. An average value of the current i1 is 0.6 [A], and an effective value thereof is 0.7 [A].

The current i2 flows through a circuit that is connected in parallel with the first capacitor 62 by a voltage of the charged first capacitor 62. An average value of the current i2 is approximately 0 [A], and an effective value thereof is 1.1 [A]. Further, the first capacitor 62 outputs the current i2 according to the switching in the driver IC 52 which is a load. Therefore, the current i2 becomes a current of which rising and falling are sharp.

The current i3, which is the sum of a part of the current i1 and the current i2, flows through the fuse 64. An average value of the current i3 is 0.6 [A] and an effective value thereof is 1.2 [A]. Since the current i3 includes the current i2, the current i3 also becomes a current for which rising and falling are sharp. Further, apart of the current i3 charges the second capacitor 63.

The current i4 flows through a circuit connected in parallel with the second capacitor 63 by a voltage of the charged second capacitor 63. An average value of the current i4 is approximately 0 [A] and an effective value thereof is 0.7 [A]. Further, the second capacitor 63 outputs the current i4 according to the switching in the driver IC 52 which is the load. Therefore, the current i4 becomes a current for which rising and falling are sharp.

According to the configuration described above, the sum of the current i3 excluding the current that charges the second capacitor 63 and the current i4 is supplied to the driver IC 52 as a drive current i5.

As described above, the ink jet head 19 includes the protection circuit 54 that cuts off the connection between the head controller 20 which is the power supply source and the driver IC 52 when the through current is generated. The protection circuit 54 includes the first capacitor 62 provided in the power supply line 61 for supplying the power to the driver IC 52. Further, the protection circuit 54 includes the second capacitor 63 that has a capacitance value lower than that of the first capacitor 62 and is provided in parallel with the first capacitor 62 at a position closer to the driver IC 52 than the first capacitor 62 of the power supply line 61. Further, the protection circuit 54 includes the fuse 64 provided between the first capacitor 62 and the second capacitor 63.

According to the configuration described above, a part of the drive current i5 supplied to the driver IC 52 is configured with the current i4 not passing through the fuse 64. That is, the fuse 64 is provided at a position through which the current from the second capacitor 63 does not flow. Accordingly, the current during the time of the normal operation of the driver IC 52 can be secured and the current (the effective value of the current) passing through the fuse 64 can be reduced. As a result, the amperage rating of the fuse 64 can be reduced. That is, a size of the fuse 64 is suppressed and thus the ink jet head 19 can be miniaturized.

Next, a method of determining the amperage rating of the fuse 64, that is, a melting characteristic will be described.

The melting characteristic of the fuse 64 is determined according to the through current generated in the driver IC 52. A lower limit of the current of when the driver IC 52 or the COF package is broken by the heat generation of when the through current is generated in the driver IC 52 is assumed to be 3.5 [A]. In this case, the melting characteristic of the fuse 64 is selected so as to cut off the power supply line 61 and the driver IC 52 before the through current in the driver IC 52 reaches 3.5 [A]. In this example, a value of the current (that is, the abnormal current) cut off by the fuse 64 is set to 3.2 [A].

As a fuse that can be reliably melted at the drive current i5 of 3.2 [A] and as a product of general manufacture, there is, a fuse-type element having a melting characteristic of 250[%] of a rated current of 1.25 [A]. The melting characteristic refers to a fuse that is melted within 5 [sec] when a current of 3.125 [A] flows therethrough.

Further, two additional considerations for selecting the fuse 64 are necessary: that the fuse can be surely melted at an abnormal current and the fuse is not melted at a normal current. The normal current includes the current when driving is performed at the maximum drive voltage of the product specification and the current when power is initially turned on.

Further, when the current waveform applied to the fuse 64 is complex, it is required to estimate and select a margin for a product variation to be 25% or less of the melting characteristic of the Joule Integral (I^2*t) characteristic. Even though there are various methods for a margin estimation method, the margin can be estimated by performing, for example, actual machine verification in parallel with the designing.

Further, with respect to the current when the power is turned on, since there is a generally a requirement that a fuse will not be melted at the 100,000 times pulse endurance line with respect to the Joule integral (I^2*t) characteristics, selection is performed to meet this requirement.

As described above, since the effective value of the current i3 flowing through the fuse 64 during normal driving is 1.2 [A], when it is assumed that a target time is 100 [sec], the Joule integral value becomes 144 [A^2*sec]. Here, according to the melting characteristic of the fuse, when the target time is 100 [sec], the Joule integral value of the fuse becomes 784 [A^2*sec]. When the margin of 25% is estimated, the Joule integral value thereof becomes 196 [A^2*sec]. Accordingly, since the Joule integral value of the current i3 flowing through the fuse 64 during the normal driving is smaller than the value in which the margin of 25% of the Joule integral value of the fuse 64 is estimated, it can be considered that the fuse is not melted. However, a case of reducing the effective value of the normal drive current causes a trade-off with the current when the power is turned on.

Next, an effective range of a ratio of the capacitance value of the second capacitor 63 to the first capacitor 62 will be described.

As described above, the normal current includes the current when driving is performed at the maximum drive voltage of the product specification and the current when the power is turned on.

First, an example in which driving is performed at the maximum drive voltage will be described.

Figure 8:
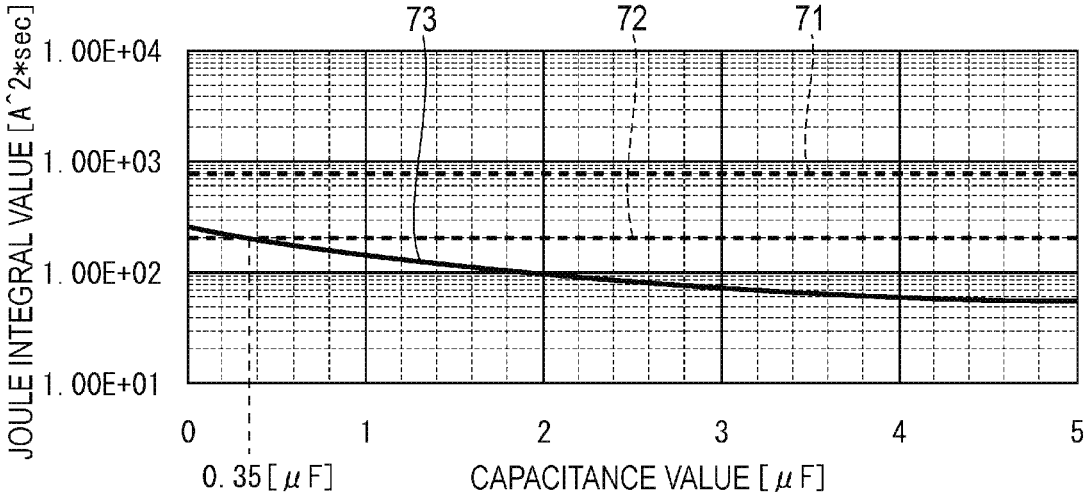
FIG. 8 is a graph illustrating a relationship between a Joule integral value generated by a current flowing through a fuse, a melting characteristic of the fuse, and a capacitance value of a second capacitor.

FIG. 8 is a graph illustrating a relationship between the Joule integral value generated by the current i3 flowing through the fuse 64, the melting characteristic of the fuse 64, and the capacitance value of the second capacitor 63. A vertical axis of FIG. 8 indicates the Joule integral value. A horizontal axis of FIG. 8 indicates the capacitance value of the second capacitor 63. Further, since a bias is applied during the normal driving, the capacitance value of the first capacitor 62 is assumed to be 4 [μF]. The capacitance value of the second capacitor 63 is shown in FIG. 8 in the range from 0 [μF] to 5 [μF].

An example of FIG. 8 shows a Joule integral value (100%) 71 of the fuse 64, a Joule integral value (25%) 72 of the fuse 64 estimating a margin, and a Joule integral value 73 generated by the current i3. The Joule integral value 73 generated by the current i3 decreases as the capacitance value of the second capacitor 63 increases.

When the capacitance value of the second capacitor 63 is equal to or greater than 0.35 [μF], the Joule integral value 73 generated by the current i3 falls below the Joule integral value (25%) 72 of the fuse 64 estimating the margin. That is, when the capacitance value of the second capacitor 63 is equal to or greater than 0.35 [μF], the current i3 flowing through the fuse 64 can be sufficiently reduced by the second capacitor 63. That is, the fuse 64 can be operated so as not to be melted.

Next, an example of when the power is turned on will be described.

Figure 9:
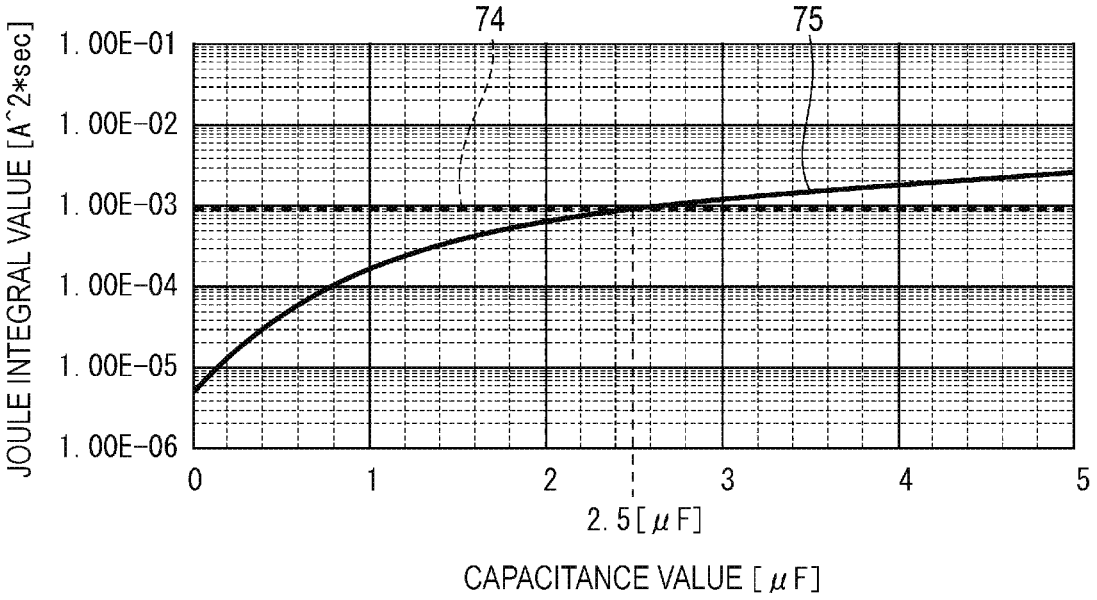
FIG. 9 is a graph illustrating a relationship between the Joule integral value, a 100,000 times pulse endurance line, and the capacitance value of the second capacitor.

FIG. 9 is a graph illustrating a relationship between the Joule integral value generated by the current i3 flowing through the fuse 64, the 100,000 times pulse endurance line, and the capacitance value of the second capacitor 63. A vertical axis of FIG. 9 indicates the Joule integral value. A horizontal axis of FIG. 9 indicates the capacitance value of the second capacitor 63. Further, since the bias is not applied when the power is turned on, the capacitance value of the first capacitor 62 is 10 [μF]. The capacitance value of the second capacitor 63 is shown in FIG. 8 in the range from 0 [μF] to 5 [μF]. Further, the power starts to be turned on at the shortest of 5 [μsec], and the time required for completing charging is 15 [μsec].

When the power is turned on, the first capacitor 62 and the second capacitor 63 are empty. Therefore, the first capacitor 62 is initially charged by the power supply voltage VAA input via the power supply line 61. Next, the current i2 from the first capacitor 62 and a part of the current i1 of the power supply line 61 pass through the fuse 64, thereby charging the second capacitor 63. Accordingly, the upper limit of the capacitance value of the second capacitor 63 is determined so that the fuse 64 is not melted by the current when the second capacitor 63 is initially charged.

The 100,000 times pulse endurance line is a criterion that becomes a selection criteria of the fuse. This indicates a condition of the Joule integral value in which the fuse is not melted even though switching between on and off states is repeated 100,000 times. In the example shown in FIG. 9, the 100,000 times pulse endurance line is 0.0008 [A^2*sec].

The example of FIG. 9 shows a 100,000 times pulse endurance line 74 and a Joule integral value 75 generated by the current when the second capacitor 63 is initially charged. The Joule integral value 75 increases as the capacitance value of the second capacitor 63 increases.

When the capacitance value of the second capacitor 63 is equal to or less than 2.5 [μF], the Joule integral value 75 falls below the 100,000 times pulse endurance line 74. That is, when the capacitance value of the second capacitor 63 is equal to or less than 2.5 [μF], the fuse 64 can be prevented from being melted even though the on and off states are repeated 100,000 times. That is, when the capacitance value of the second capacitor 63 is equal to or less than 2.5 [μF], it can be considered that it falls below 0.0008 [A^2*sec] when the target time is 15 [μsec] in the 100,000 times pulse endurance line 74 of the fuse 64, and the fuse is not melted.

As described above, the melting characteristic of the fuse 64 is determined by the normal current of the driver IC 52 or the current at which the driver IC 52 is broken. Further, the ratio of the capacitance value of the second capacitor 63 to the capacitance value of the first capacitor 62 is determined based upon the melting characteristic of the fuse 64 and the normal current of the driver IC 52.

Accordingly, the current passing through the fuse 64 can be reduced by the second capacitor 63 not only to secure the current during the normal operation of the driver IC 52 but also to prevent the fuse 64 from being melted during the normal operation. As a result, the amperage rating of the fuse 64 can be reduced. As a result, the size of the fuse 64 can be suppressed and thus the ink jet head 19 can be miniaturized.

Further, when the first capacitor 62 and the second capacitor 63 are ceramic capacitors, the capacitance values thereof are reduced by the bias to be applied. Therefore, when the ceramic capacitor is used, a complementary measure for the bias is required.

As described above, when the bias is not applied, the capacitance value of the first capacitor 62 is 10 [μF], whereas when the power supply voltage VAA of 31 [V] is applied, the capacitance value thereof becomes 4 [μF].

When the bias is not applied, the capacitance value of the second capacitor 63 is 1 [μF], whereas when the power supply voltage VAA of 31 [V] is applied, the capacitance value thereof becomes 0.44 [μF]. That is, the capacitance value of the second capacitor 63 becomes −56% by the bias of 31 [V]. Based upon the reduction rate, the capacitance value when the bias is not applied of the capacitor whose capacitance value becomes 0.35 [μF] when the bias of 31 [V] is applied is 0.8 [μF].

As described above, the second capacitor 63 is configured with the capacitor whose capacitance value is in the range of 0.8 [μF] to 2.5 [μF] when the bias is not applied. Accordingly, the ink jet head 19 can drive the actuator by surely melting the fuse 64 at the abnormal current and without melting the fuse 64 at the normal current.

Further, since the capacitance value of the first capacitor 62 is 10 [μF] when the bias is not applied, the range of 0.8 [μF] to 2.5 [μF] can be replaced with the range of 8% to 25% of the capacitance value of the first capacitor 62. That is, the ink jet head 19 can achieve the miniaturization of the fuse 64 by using the second capacitor 63 of the capacitance value in the range of 8% to 25% of the capacitance value of the first capacitor 62.

Further, the range of the capacitance value from 0.8 [μF] to 2.5 [μF] when the bias is not applied can be replaced with the range of the capacitance value from 0.35 [μF] to 1.1 [μF] when the bias is applied. Since the capacitance value of the first capacitor 62 is 4 [μF] when the bias is applied, the range of 0.35 [μF] to 1.1 [μF] can be replaced with the range of 9% to 27% of the capacitance value of the first capacitor 62. That is, when a specific bias is applied to the first capacitor 62 and the second capacitor 63, the second capacitor 63 having the capacitance value in the range of 8% to 25% of the capacitance value of the first capacitor 62 is used, thereby making it possible for the ink jet head 19 to achieve the miniaturization of the fuse 64.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink jet head, comprising:

an actuator configured to cause ink to be discharged from nozzles;

a driver IC connected to a power supply line and configured to drive the actuator;

a first capacitor connected between a ground line and a first node of the power supply line;

a second capacitor connected between the ground line and a second node of the power supply line, the second node being between the first node and the driver IC, a capacitance of the second capacitor being smaller than a capacitance of the first capacitor; and a fuse on the power supply line between the first node and the second node.

2. The ink jet head according to claim 1, wherein the ground line is connected to the driver IC, and the first capacitor is connected to a third node of the ground line and the second capacitor is connected to a fourth node of the ground line, and the fourth node is between the third node and the driver IC.

3. The ink jet head according to claim 1, wherein the capacitance of the second capacitor is in a range of 8% to 25% of the capacitance of the first capacitor.

4. The ink jet head according to claim 1, wherein the capacitance of the first capacitor and the capacitance of the second capacitor are both variable based on a bias voltage respectively applied thereto, and the capacitance of the second capacitor when being biased is in a range of 9% to 27% of the capacitance of the first capacitor when being biased.

5. The ink jet head according to claim 1, wherein the driver IC includes:

a logic circuit configured to generate a drive signal;

a level shifter configured to shift a voltage level of the drive signal to generate a level-shifted drive signal; and a driver configured to operate based on power supplied from the power supply line and output, based on the level-shifted drive signal, a signal of one of a first level, based on a voltage level of the power supply line, and a second level based on a ground voltage level.

6. The ink jet head according to claim 5, wherein the logic circuit is configured to operate based on power supplied from a second power supply line different from the power supply line, and the level shifter is configured to operate based on power supplied from a third power supply line different from the power supply line and the second power supply line.

7. The ink jet head according to claim 1, further comprising:

a head substrate, wherein the first capacitor, the second capacitor, the fuse, and at least a part of the power supply line are provided on the head substrate.

8. An ink jet head, comprising:

an actuator configured to cause ink to be discharged from nozzles;

a driver IC configured to drive the actuator;

a power supply line connected to the driver IC;

a ground line connected to the driver IC; and a protection circuit including:

a first capacitor connected between the ground line and a first node of the power supply line;

a second capacitor connected between the ground line and a second node of the power supply line, the second node being between the first node and the driver IC, a capacitance of the second capacitor being less than a capacitance of the first capacitor; and a fuse on the power supply line between the first node and the second node.

9. The ink jet head according to claim 8, wherein the first capacitor is connected to a third node of the ground line and the second capacitor is connected to a fourth node, the fourth node being between the third node and the driver IC.

10. The ink jet head according to claim 8, wherein the capacitance of the second capacitor is in a range of 8% to 25% of the capacitance of the first capacitor.

11. The ink jet head according to claim 8, wherein the capacitance of the first capacitor and the capacitance of the second capacitor are both variable based on a bias voltage applied thereto, and the capacitance of the second capacitor when being biased is in a range of 9% to 27% of the capacitance of the first capacitor when being biased.

12. The ink jet head according to claim 8, wherein the driver IC includes:

a logic circuit configured to generate a drive signal;

a level shifter configured to shift a voltage level of the drive signal to generate a level-shifted drive signal; and a driver configured to operate based on power supplied from the power supply line and output, based on the level-shifted drive signal, a signal of one of a first level based on a voltage level of the power supply line and a second level based on a ground voltage level.

13. The ink jet head according to claim 12, wherein the logic circuit is configured to operate based on power supplied from a second power supply line different from the power supply line, and the level shifter is configured to operate based on power supplied from a third power supply line different from the power supply line and the second power supply line.

14. The ink jet head according to claim 8, further comprising:

a head substrate, wherein the first capacitor, the second capacitor, the fuse, at least a part of the power supply line, and at least a part of the ground line are provided on the head substrate.

15. An ink jet printer, comprising:

a conveyance motor configured to convey a sheet;

an ink jet head configured to discharge ink onto the sheet; and a head controller configured to supply power and a control signal to the ink jet head, wherein the ink jet head comprises:

an actuator configured to cause ink to be discharged from nozzles;

a driver IC configured to drive the actuator;

a first capacitor connected between a ground line and a first node of a power supply line connected to the driver IC;

a second capacitor connected between the ground line and a second node of the power supply line, the second node being between the first node and the driver IC, a capacitance of the second capacitor being less than a capacitance of the first capacitor; and a fuse on the power supply line between the first node and the second node.

16. The ink jet printer according to claim 15, wherein the first capacitor is connected to a third node of the ground line and the second capacitor is connected to a fourth node of the ground line, the fourth node being between the third node and the driver IC.

17. The ink jet printer according to claim 15, wherein the capacitance of the second capacitor is in a range of 8% to 25% of the capacitance of the first capacitor.

18. The ink jet printer according to claim 15, wherein the capacitance of the first capacitor and the capacitance of the second capacitor are both variable based on a bias voltage applied thereto, and the capacitance of the second capacitor when being biased is in a range of 9% to 27% of the capacitance of the first capacitor when being biased.

19. The ink jet printer according to claim 15, wherein the driver IC includes:

a logic circuit configured to generate a drive signal;

a level shifter configured to shift a voltage level of the drive signal to generate a level-shifted drive signal; and a driver configured to operate based on power supplied from the power supply line and output, based on the level-shifted drive signal, a signal of one of a first level, based on a voltage level of the power supply line, and a second level, based on a ground voltage level.

20. The ink jet printer according to claim 19, wherein the logic circuit is configured to operate based on power supplied from a second power supply line different from the power supply line, and the level shifter is configured to operate based on power supplied from a third power supply line different from the power supply line and the second power supply line.

* * * * *